US006811518B2

(12) United States Patent
Lin

(10) Patent No.: US 6,811,518 B2
(45) Date of Patent: Nov. 2, 2004

(54) TREADMILL HAVING A POWERED FOLDING DEVICE

(76) Inventor: Michael Lin, 7F-3, No. 181, Fu Hsin North Road, Chong San Chu, Taipei (TW), 104

( * ) Notice: Subject to any disclaimer, the term of this patent is extended or adjusted under 35 U.S.C. 154(b) by 220 days.

(21) Appl. No.: 10/155,717

(22) Filed: May 28, 2002

(65) Prior Publication Data

US 2003/0224908 A1 Dec. 4, 2003

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,855,537 A * 1/1999 Coody et al. ..... 482/54

6,077,200 A 6/2000 Lin ..... 482/54

* cited by examiner

*Primary Examiner*—Glenn E. Richman
(74) *Attorney, Agent, or Firm*—Charles E. Baxley

(57) ABSTRACT

A treadmill includes a handle device disposed on a seat, a tread base rotatable between a downward working position and an upward folding position. Two arms and two levers and two bars are pivotally secured between the tread base and the seat, for allowing the tread base to be rotated relative to the seat. A tube may be secured to the arms, a bolt is threaded with the tube, and a motor may be coupled to the bolt for rotating the bolt to move the tube away from and toward the bolt, and thus to rotate the tread base between the downward working position and the upward folding positions.

6 Claims, 10 Drawing Sheets

TREADMILL HAVING A POWERED FOLDING DEVICE

BACKGROUND OF THE INVENTION

1. Field of the Invention

The present invention relates to a treadmill, and more particularly to a treadmill having a powered folding device for folding the treadmill.

2. Description of the Prior Art

Typical treadmills may include a tread base foldable relative to a seat and foldable between a downward working position and an upward folding and storing position. The applicant has developed one of the treadmills and disclosed in U.S. Pat. No. 6,077,200 to Lin. The tread base is required to be folded upward to the folding position or rotated downward to the working position manually.

The present invention has arisen to mitigate and/or obviate the afore-described disadvantages of the conventional treadmills.

SUMMARY OF THE INVENTION

The primary objective of the present invention is to provide a treadmill including a powered folding device for folding the treadmill automatically, without being folded manually.

The other objective of the present invention is to provide a treadmill including a safety device for allowing the powered folding device to be safely operated, and for preventing the children from being hurt by the treadmill.

In accordance with one aspect of the invention, there is provided a treadmill comprising a seat, a handle device disposed on the seat, a tread base disposed above the seat, and rotatable between a downward working position and an upward folding position, power driving means for moving the tread base between the downward working position and the upward folding position, a switch button for actuating the power driving means to move the tread base, and a safety switch for actuating the power driving means to move the tread base only when both the switch button and the safety switch are depressed simultaneously.

The handle device includes an upper portion and a front portion, the switch button is provided on the upper portion of the handle device, and the safety switch is provided on the front portion of the handle device.

The power driving means includes a pair of arms having a first end pivotally secured to the tread base and a second end slidably secured to the seat, a pair of levers having a first end pivotally secured to a front portion of the tread base and a second end pivotally secured to the seat.

The power driving means includes a pair of bars pivotally secured between the seat and the levers respectively.

The bars each includes a first end pivotally secured to the seat, and a second end having an oblong hole formed therein, the levers each includes a middle portion having a stud secured thereto and slidably engaged in the oblong holes of the bars respectively.

A switch may further be provided and attached to the second end of the bar, the stud is engageable with the switch in order to stop the power driving means.

The seat includes a pair of tracks provided therein, and two rollers secured to the second ends of the arms respectively and slidably engaged in the tracks of the seat respectively.

Another switch may further be provided and attached to a first end of the track, the roller is engageable with the switch in order to stop the power driving means.

The power driving means includes a column secured between the second ends of the arms, a tube secured to the column, a bolt threaded with the tube, and means for rotating the bolt relative to the tube to move the tube relative to the bolt.

The rotating means includes a housing secured to the seat, a motor secured to the housing and having a spindle and a first gear secured to the spindle, a second gear secured to the bolt and engaged with the first gear, for allowing the bolt to be driven by the motor.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
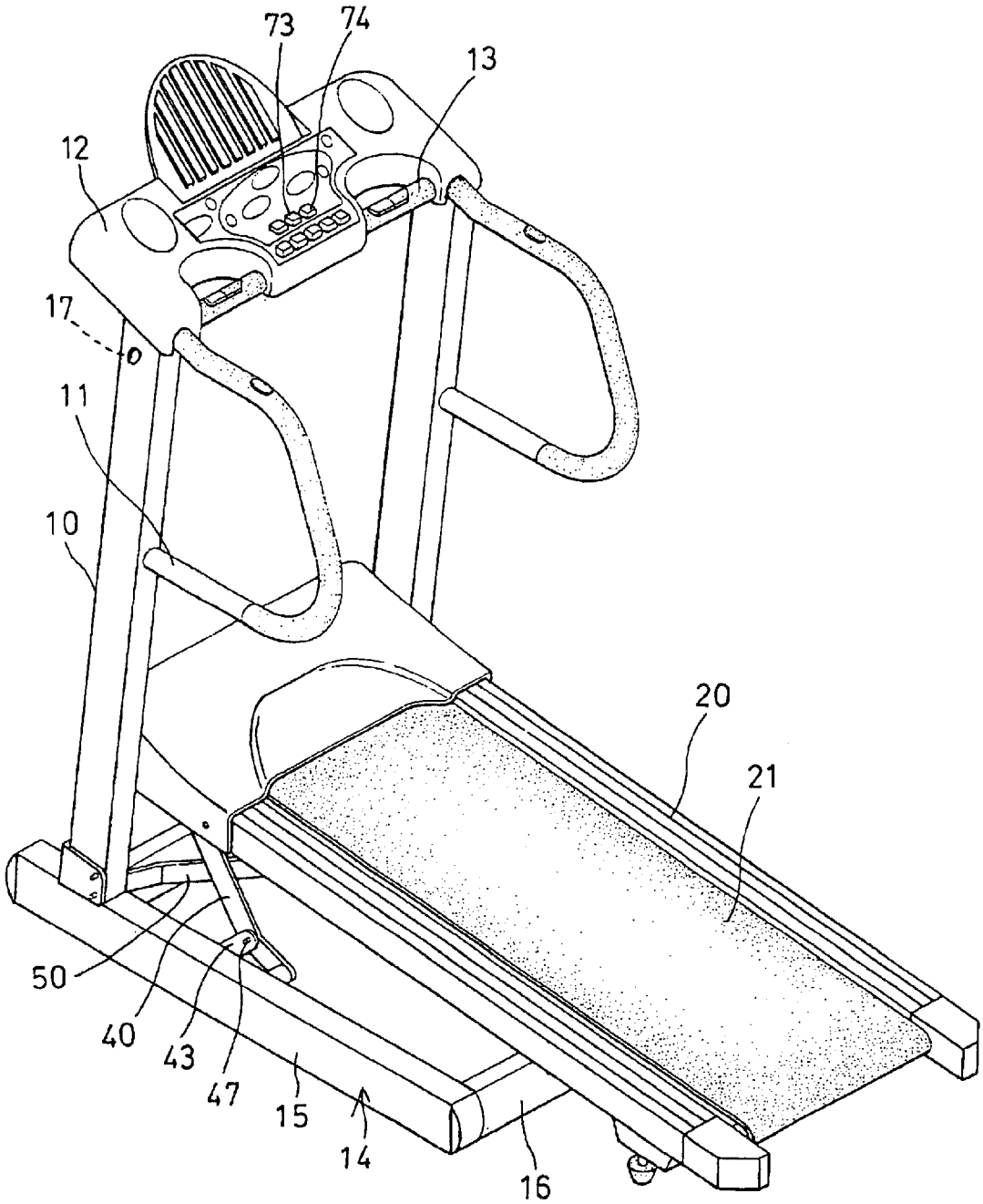
FIG. 1 is a perspective view of a treadmill in accordance with the present invention, in which the tread base is rotated downward to the downward working position.
Figure 2:
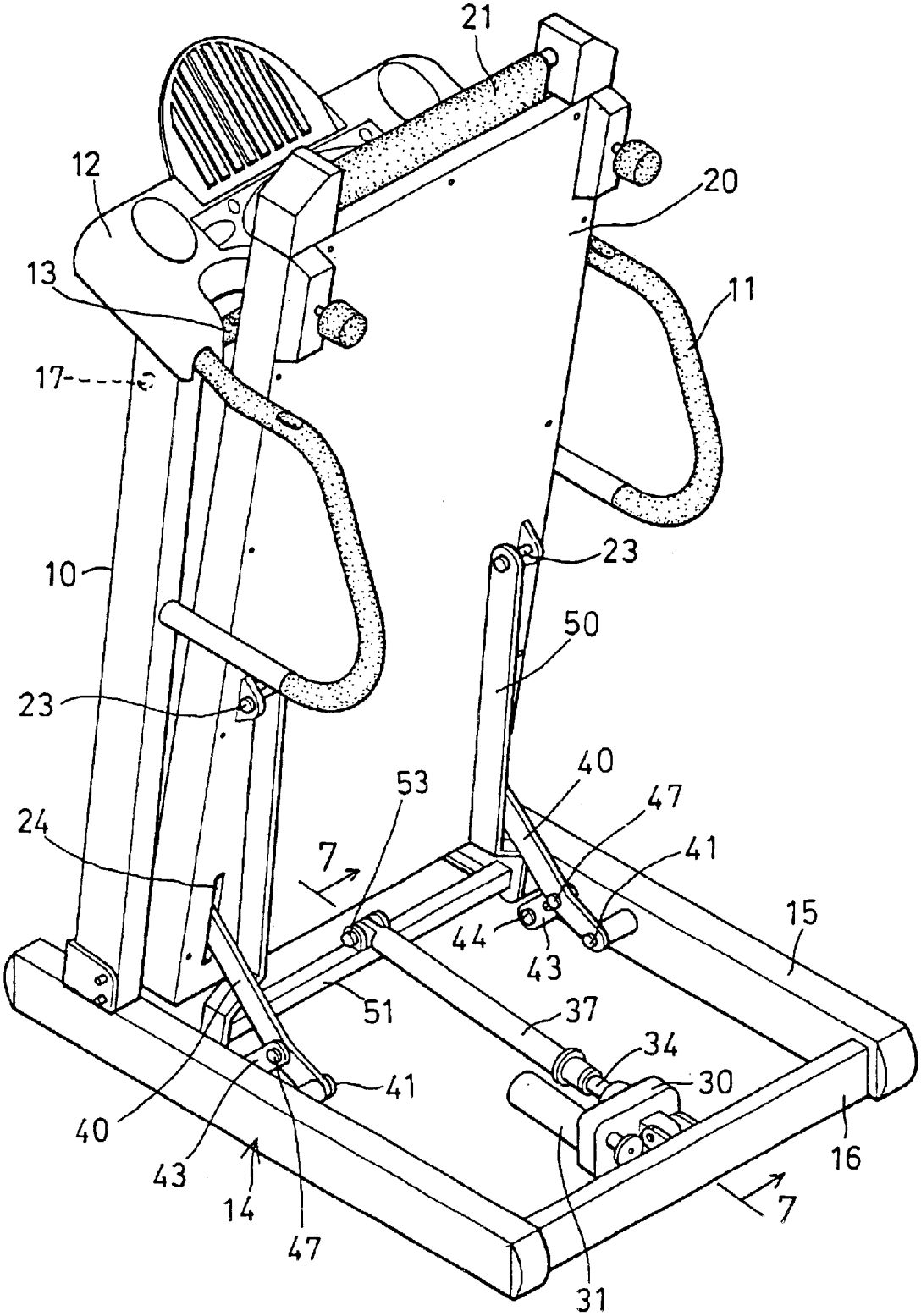
FIG. 2 is a perspective view of the treadmill similar to FIG. 1, in which the tread base is rotated or folded upward to the upward folding or storing position.
Figure 3:
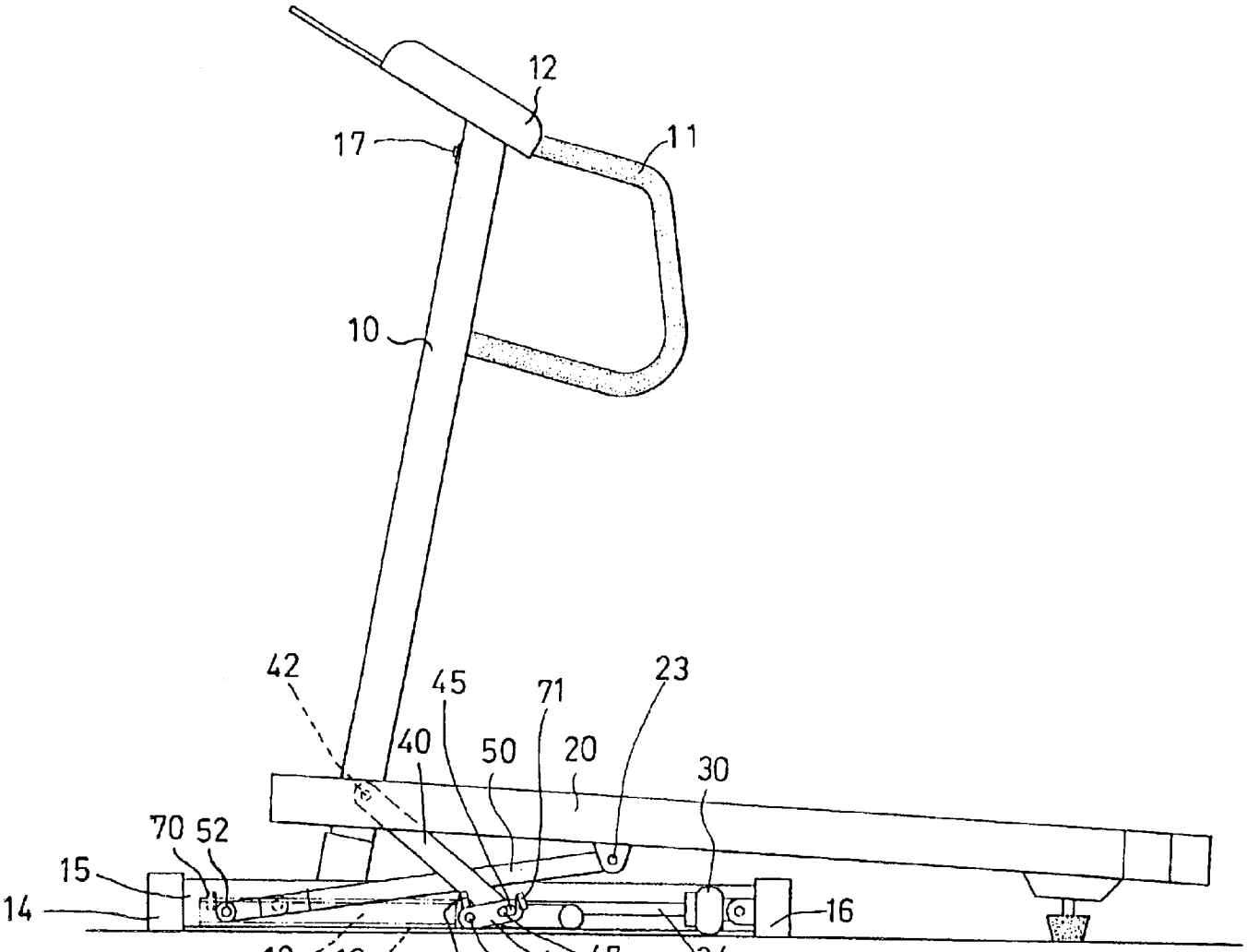
FIG. 3 is a side view of the treadmill.
Figure 4:
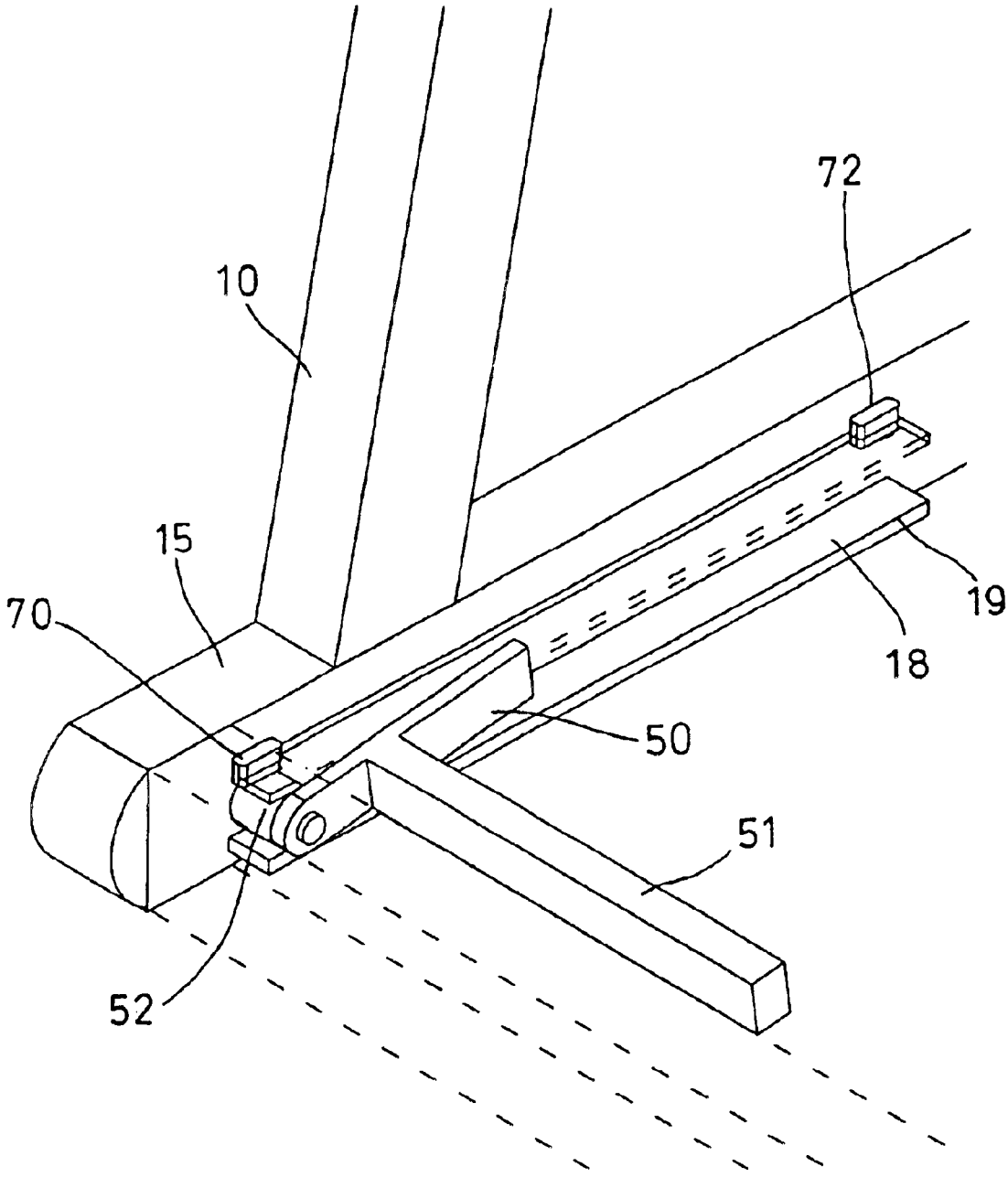
FIGS. 4, 5, 6 are enlarged partial perspective views illustrating the operation of the treadmill.

Referring to the drawings, and initially to FIGS. 1–3, a treadmill in accordance with the present invention comprises one or more posts or a handle device 10 disposed or extended upward from a seat 14. The handle device 10 may also be arranged to be selectively folded downward toward and to engage with the seat 14. One or more hand grips 11, 13 and a control panel 12 are provided and disposed on top of the handle device 10. The seat 14 includes a pair of parallel side beams 15, and a rear beam 16 secured between the rear portions of the side beams 15. The handle device 10 may include one or more safety switches 17 provided or disposed thereon, particularly attached to the front and upper portion of the handle device 10.

Figure 10:
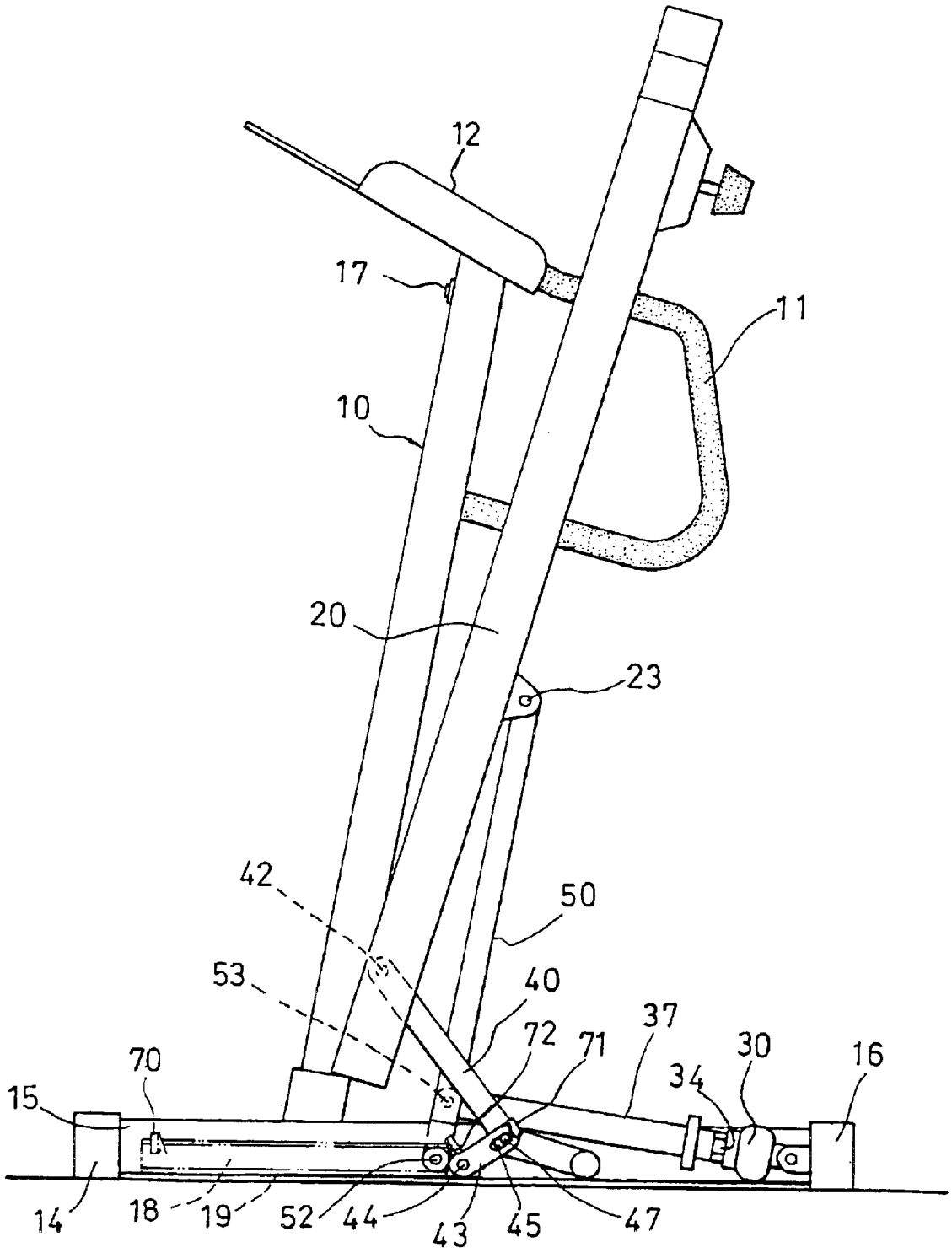

The seat 14 includes one or more, such as two channels or tracks 18 formed and provided in the front portion thereof. For example, each of the side beams 15 includes a pair of parallel flaps or flanges 19 extended inward from the front portion thereof and parallel to each other for forming or defining the tracks 18 thereof, best shown in FIGS. 3–6. A tread base 20 is disposed above the seat 10, and includes a typical endless belt 21 provided therein for supporting the users, and for allowing the users to conduct jogging, walking or the other exercises. The tread base 20 is rotatable or foldable between a downward working position (FIGS. 1, 3) and an upward folding or storing position (FIGS. 2, 10).

One or more, such as two arms 50 each includes one end pivotally or rotatably secured to the middle and bottom portion of the tread base 20 with pivot axles 23, and a column 51 is secured between the other ends of the arms 50 for solidly coupling the arms 50 together, and for forming a substantially parallelepiped structure. The arms 50 each includes a wheel or a roller 52 secured to the other end thereof and slidably engaged in the respective tracks 18 of the seat 14, best shown in FIG. 4, for allowing the other ends of the arms 50 to be moved along the tracks 18 of the seat 14.

Figure 9:
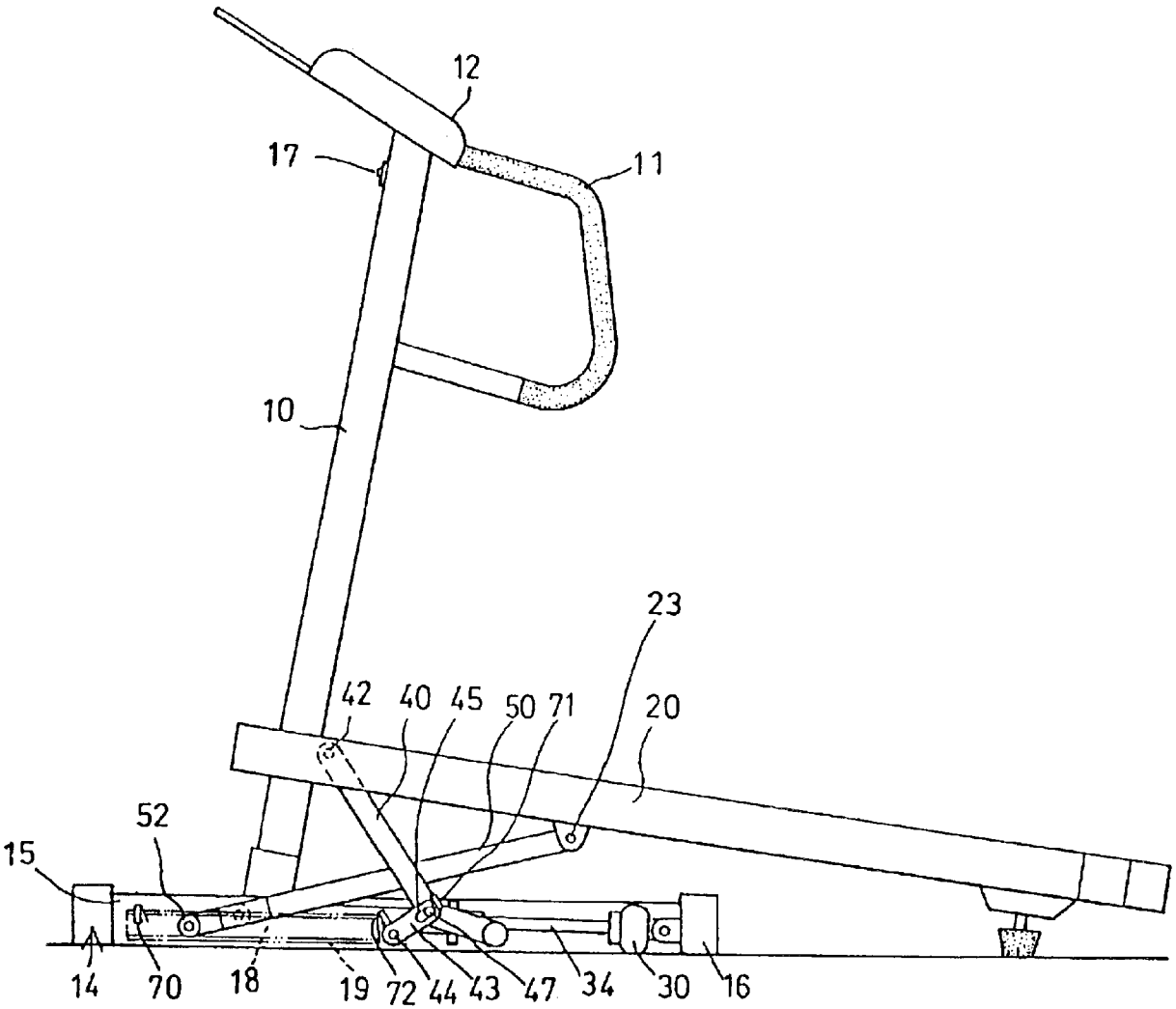
FIGS. 9 and 10 are side views similar to FIG. 3, illustrating the operation of the treadmill.

The tread base 20 includes one or more, such as two grooves 24 formed in the front and bottom portion thereof (FIG. 2). One or more, such as two levers 40 are further provided and each includes one end pivotally or rotatably secured to the middle portion of the seat 10 with pivot shafts 41 respectively, and the other ends engaged into the grooves 24 of the tread base 20 and pivotally or rotatably secured to the front and bottom portion of the tread base 20 with pivot pins 42 (FIGS. 3, 9, 10). The levers 40 each preferably includes a bent portion formed in the middle portion thereof and having a stud 47 attached thereto.

Figure 5:
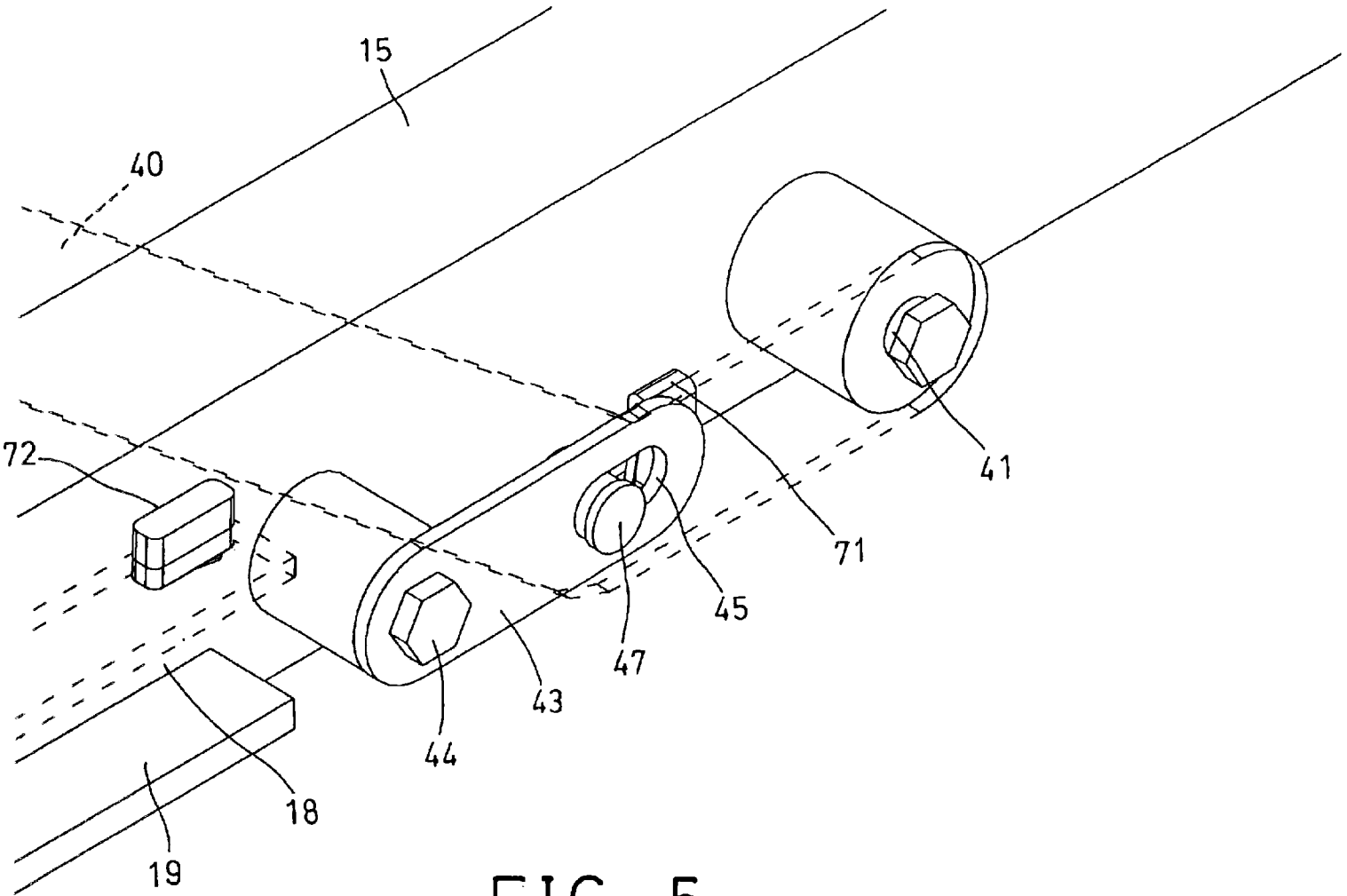
Figure 6:
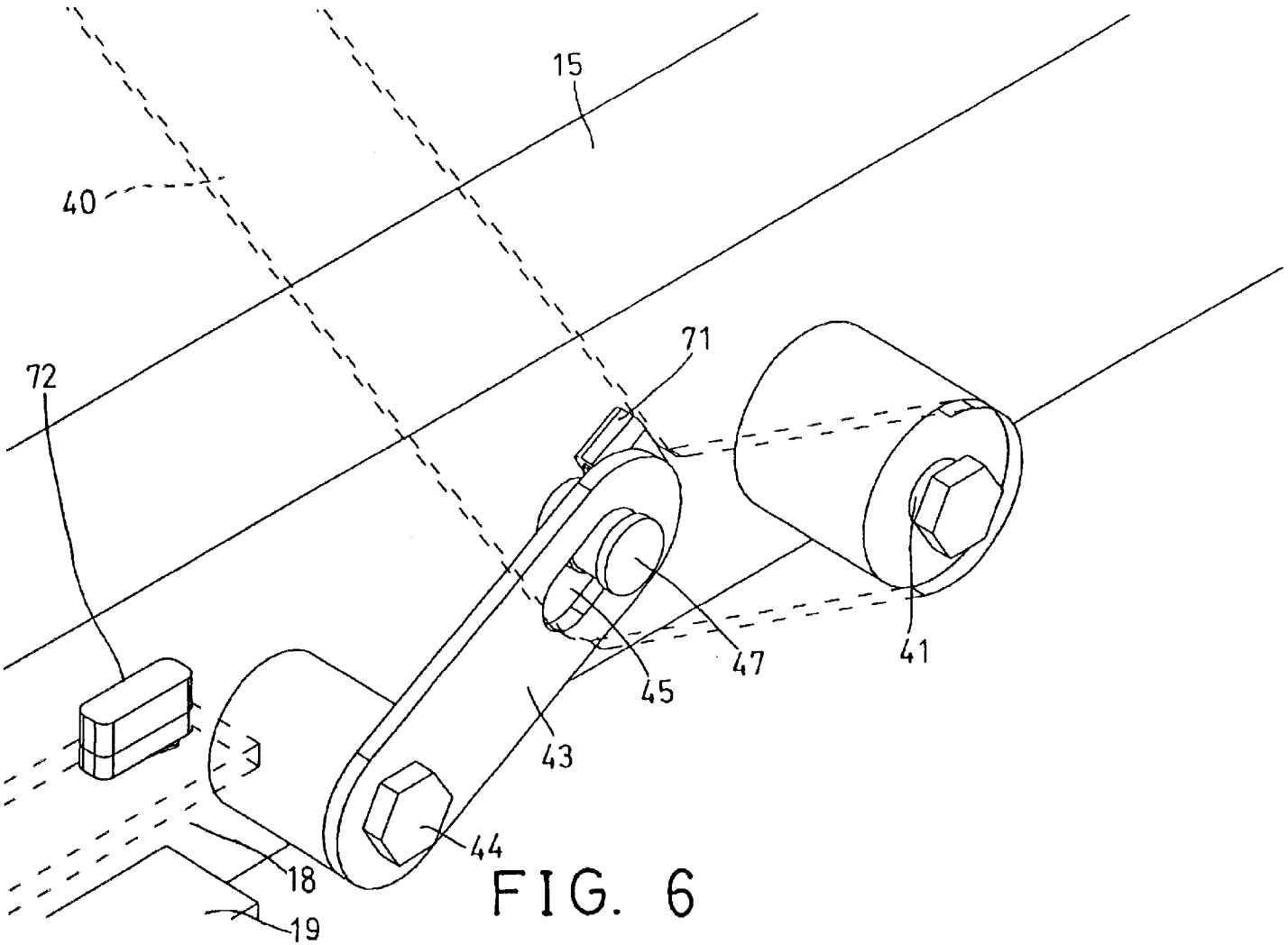

Two bars 43 each includes one end pivotally or rotatably secured to the middle portion of the seat 10 with pivot rods 44 which are located in front of the pivot shafts 41 respectively (FIGS. 5, 6). The bars 43 each includes the other ends having an oblong hole 45 formed therein for slidably receiving the studs 47 therein, and for allowing the studs 47 to be moved between the ends of the oblong holes 45 of the bars 43 respectively (FIGS. 5, 6). The arms 50 and the levers 40 and the bars 43 are arranged for allowing the tread base 20 to be rotatable or foldable between the downward working position (FIGS. 1, 3) and the upward folding or storing position (FIGS. 2, 10).

The treadmill further includes a powered folding or driving device for automatically folding the tread base 20. A housing 30 is secured to the rear portion of the seat 14, such as secured to the rear beam 16 of the seat 14. A motor 31 is secured to the housing 30, and includes a worm or a gear 32 secured to the spindle 33 thereof and rotatably received and supported in the housing 30. A bolt 34 has one end 35 rotatably received in the housing 30, and another worm or gear 36 is secured on the end 35 of the bolt 34 and engaged with the gear 32, for allowing the bolt 34 to be rotated and driven by the motor 31.

Figure 7:
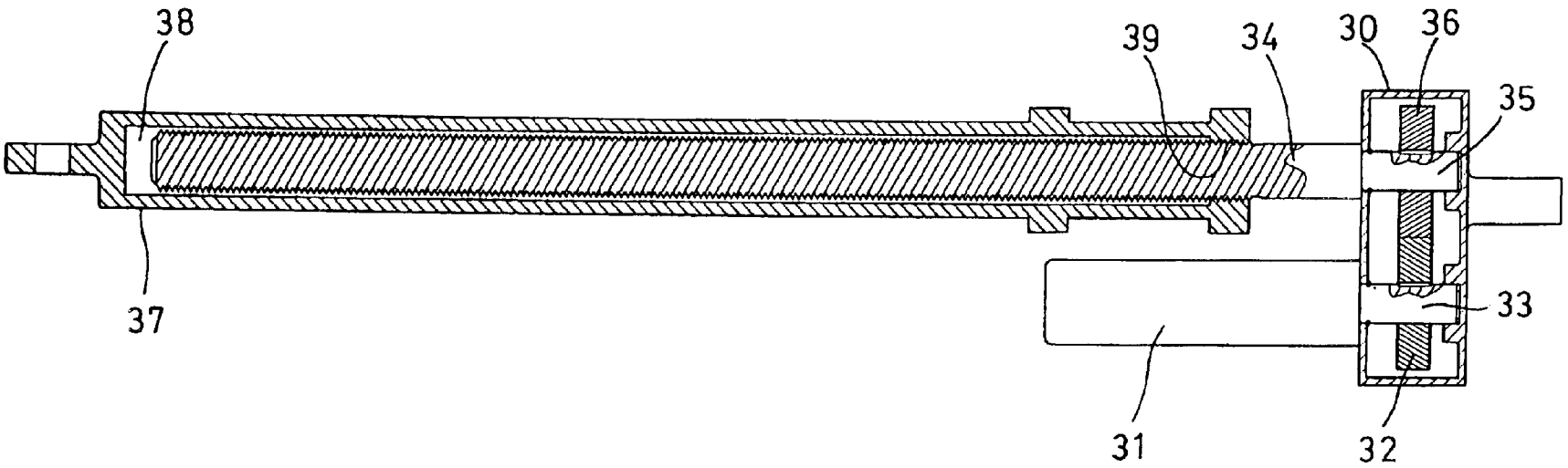
FIG. 7 is a partial cross sectional view taken along lines 7—7 of FIG. 2.
Figure 8:
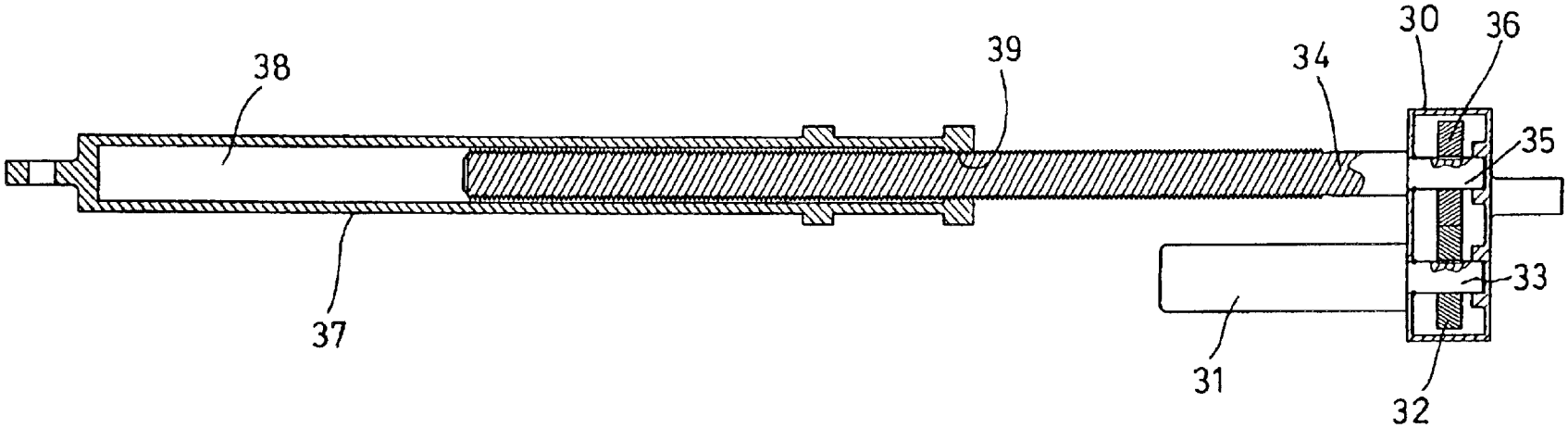
FIG. 8 is a partial cross sectional view similar to FIG. 7, illustrating the operation of the treadmill.

A tube 37 has one end pivotally or rotatably secured to the middle portion of the column 51, and includes a bore 38 formed therein for receiving the bolt 34, and includes an inner thread 39 formed in the other end thereof for threading with the bolt 34. In operation, as shown in FIGS. 7 and 8, when the bolt 34 is rotated or driven by the motor 31, the tube 37 may be caused to be moved away from and toward the bolt 34 by the threading engagement of the inner thread 39 of the tube 37 and the outer thread of the bolt 34, best shown in FIGS. 2, 3, and 7–10.

In operation, when the tube 37 is caused to be moved away from the bolt 34 by the threading engagement of the inner thread 39 of the tube 37 and the outer thread of the bolt 34, and by the motor 31, the column 51 and the arms 50 may be moved forward by the tube 37, and the rollers 52 may be caused to move toward the front ends of the tracks 18 respectively. The levers 40 may retain the front portion of the tread base 20 relative to the seat 14; i.e., the front portion of the tread base 20 may not be moved forward relative to the seat 14, such that the rear portion of the tread base 20 may be moved or rotated downward to the working position as shown in FIGS. 1 and 3.

On the contrary, when the tube 37 is caused to be moved toward the bolt 34 or toward the housing 30 by the motor 31, the column 51 and the arms 50 may be moved rearward by the tube 37, and the rollers 52 may be caused to move toward the rear ends of the tracks 18 respectively. The levers 40 may retain the front portion of the tread base 20 relative to the seat 14 such that the rear portion of the tread base 20 may be moved or rotated upward to the upward folding or storing position as shown in FIGS. 2 and 10.

As shown in FIGS. 3–6, 9 and 10, two switches, such as two microswitches 70, 72 are disposed in the front and the rear portions of either or both of the tracks 18 of the seat 14. For example, when the roller 52 is engaged with the front microswitch 70, the motor 31 may be stopped for preventing the roller 52 from moving further forward relative to the tracks 18, or for preventing the roller 52 from being disengaged from the tracks 18. When the roller 52 is engaged with the rear microswitch 70, the motor 31 may also be stopped for limiting the rearward movement of the roller 52 relative to the tracks 18, or for preventing the roller 52 from being disengaged from the tracks 18.

Another switch, such as the microswitch 71 is disposed on the free end of either or both of the bars 43 for engaging with the stud 47. As shown in FIGS. 3 and 5, when the tread base 20 is moved or rotated downward to the working position, the stud 47 will not contact the microswitch 71. However, as shown in FIGS. 2, 6, and 10, when the tread base 20 is moved or rotated upward to the folding or storing position, the the stud 47 may be caused to move toward the other end of the oblong hole 45 of the bar 43, and may engage with the microswitch 71 in order to stop the motor 31.

Accordingly, the motor 31 may be stopped when either or both the stud 47 is engaged with the microswitch 71 and the rollers 52 are engaged with the microswitches 72. The engagement of the stud 47 with the microswitch 71, and the engagement of the rollers 52 with the microswitches 72, form a double security device for limiting the upward movement of the tread base 20 to the upward folding and storing position.

As shown in FIG. 1, when a switch button 73, for example, is depressed by the users, the tread base 20 may be moved or rotated downward to the working position as shown in FIGS. 1 and 3. When the other switch button 74 is depressed by the users, the tread base 20 may be moved or rotated upward to the upward folding or storing position as shown in FIGS. 2 and 10. For safety purposes, the treadmill further includes one or more safety switches 17 provided or disposed on the handle device 10, particularly attached to the front and upper portion of the handle device 10.

The safety switch 17 and the switch button 74 are preferably or should both be depressed for allowing the tread base 20 to be rotated upward to the upward folding position, for preventing the tread base 20 from being rotated upward to the upward folding position inadvertently, and for preventing the children from being clamped between the tread base 20 and the handle device 10 inadvertently.

The safety switch 17 and the switch button 73 should also both be depressed by the users, for allowing the tread base 20 to be rotated downward to the downward working position, for preventing the tread base 20 from being rotated downward to the downward working position inadvertently, and for preventing the children from being clamped or hit or hurt by the tread base 20 inadvertently. The switch button 73 or 74 may also be used for controlling the upward and downward movement of the tread base 20, by such as depressing the switch button 73 or 74 twice.

Accordingly, the treadmill in accordance with the present invention includes a powered folding device for folding the treadmill automatically, without being folded manually, and includes a safety device for allowing the powered folding device to be safely operated, and for preventing the children from being hurt by the treadmill.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill comprising:

a seat, a handle device disposed on said seat, a tread base disposed above said seat, and rotatable between a downward working position and an upward folding position, power driving means for moving said tread base between said downward working position and said upward folding position, said power driving means including a pair of arms having a first end pivotally secured to said tread base and a second end slidably secured to said seat, a pair of levers having a first end pivotally secured to a front portion of said tread base and a second end pivotally secured to said seat, said power driving means including a pair of bars pivotally secured between said seat and said levers respectively, each of said bars including a first end pivotally secured to said seat, and a second end having an oblong hole formed therein, each of said levers including a middle portion having a stud secured thereto and slidably engaged in said oblong holes of said bars respectively, a switch button for actuating said power driving means to move said tread base, a safety switch for actuating said power driving means to move said tread base only when both said switch button and said safety switch are depressed simultaneously, and a switch attached to said second end of said bar, said stud being engageable with said switch in order to stop said power driving means.

2. The treadmill according to claim 1, wherein said handle device includes an upper portion and a front portion, said switch button is provided on said upper portion of said handle device, and said safety switch is provided on said front portion of said handle device.

3. The treadmill according to claim 1, wherein said seat includes a pair of tracks provided therein, and two rollers secured to said second ends of said arms respectively and slidably engaged in said tracks of said seat respectively.

4. The treadmill according to claim 3 further comprising a switch attached to a first end of said track, said roller being engageable with said switch in order to stop said power driving means.

5. The treadmill according to claim 1, wherein said power driving means includes a column secured between said second ends of said arms, a tube secured to said column, a bolt threaded with said tube, and means for rotating said bolt relative to said tube to move said tube relative to said bolt.

6. The treadmill according to claim 5, wherein said rotating means includes a housing secured to said seat, a motor secured to said housing and having a spindle and a first gear secured to said spindle, a second gear secured to said bolt and engaged with said first gear, for allowing said bolt to be driven by said motor.

* * * * *